US008264145B2

(12) United States Patent
Lee et al.

(10) Patent No.: US 8,264,145 B2
(45) Date of Patent: Sep. 11, 2012

(54) DISPLAY FILTER, DISPLAY DEVICE INCLUDING THE SAME, AND METHOD OF MANUFACTURING THE SAME

(75) Inventors: Jinyoung Lee, Yongin-si (KR); Sungyong Lee, Yongin-si (KR); Jaehyung Kim, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 504 days.

(21) Appl. No.: 12/591,590

(22) Filed: Nov. 24, 2009

(65) Prior Publication Data

US 2010/0141141 A1 Jun. 10, 2010

(30) Foreign Application Priority Data

Dec. 9, 2008 (KR) ..... 10-2008-0124436

(51) Int. Cl.
*H01J 17/16* (2006.01)
*H01J 17/49* (2006.01)

(52) U.S. Cl. ..... 313/584; 313/112; 313/582

(58) Field of Classification Search ..... 313/110–117, 313/477 R–482, 581–604
See application file for complete search history.

(56) References Cited

U.S. PATENT DOCUMENTS

2004/0214503 A1* 10/2004 Kotsubo et al. ..... 445/49
2005/0253493 A1 11/2005 Park et al.
2007/0085458 A1* 4/2007 Sin et al. ..... 313/112
2007/0108881 A1 5/2007 Choi et al.
2008/0238317 A1* 10/2008 Kwon et al. ..... 313/582

FOREIGN PATENT DOCUMENTS

JP 2008-041765 A 2/2008
JP 2008-147356 A 6/2008
KR 10 2006-0046034 A 5/2006
KR 10 2007-0052520 A 5/2007
KR 10 2007-0067771 A 6/2007
KR 10 2008-0008083 A 1/2008
KR 10 2008-0037476 A 4/2008

OTHER PUBLICATIONS

Korean Notice of Allowance in KR 10-2008-0124436, dated Mar. 31, 2011 (Lee, et al.).

* cited by examiner

*Primary Examiner* — Anh Mai
*Assistant Examiner* — Nathaniel Lee
(74) *Attorney, Agent, or Firm* — Lee & Morse, P.C.

(57) ABSTRACT

A display filter includes a base layer having a plurality of structures, the plurality of structures being projected from a first surface of the base layer, an external light shielding layer on the plurality of structures, the external layer being on an upper surface and on a first side surface of the structures, and an electromagnetic wave shielding layer on the plurality of structures, the electromagnetic wave shielding layer being on the upper surface and on a second side surface of the structures, the first and second side surfaces of the structures being opposite each other, and a portion of the external light shielding layer being between the structures and a portion of the electromagnetic wave shielding layer.

20 Claims, 6 Drawing Sheets

FIG. 7

| No. | Sample | Visible light transmission ratio of a plasma display device | bright room contrast ratio of a plasma display device |
|---|---|---|---|
| 1 | display filter according to one embodiment of the present invention | 52% | 900:1 |
| 2 | usual filter 1 (electromagnetic wave shielding layer and external light shielding layer are separately made) | 40% | 850:1 |
| 3 | usual filter 2 (only electromagnetic wave shielding layer is made) | 56% | 300:1 |

FIG. 8

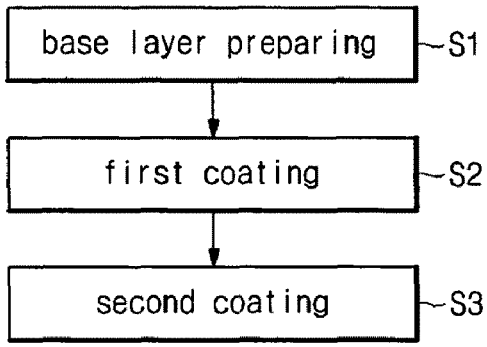

FIG. 9

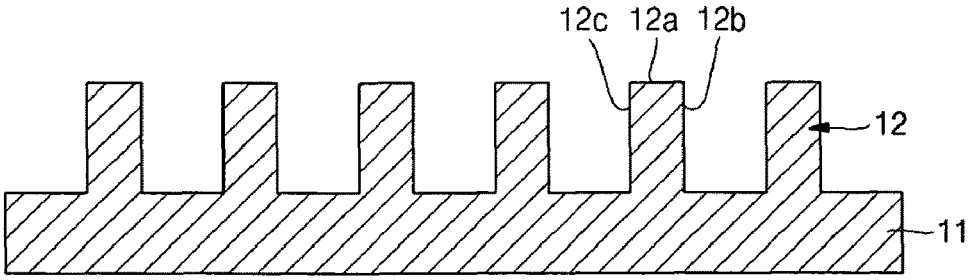

DISPLAY FILTER, DISPLAY DEVICE INCLUDING THE SAME, AND METHOD OF MANUFACTURING THE SAME

BACKGROUND

1. Field

Example embodiments relate to a display filter, a display device including the same, and a method of manufacturing the display filter.

2. Description of the Related Art

Recently, photo-electronic components and devices have been actively developed with progress of information technologies. Particularly, image display devices have been widely supplied, e.g., for a television set and a monitor of a personal computer. In addition, the image display devices have become larger and thinner.

The plasma display device may include a plasma display panel, which has a discharge cell defined by address, scan and sustain electrodes, phosphor in the discharge cell, and a driver to drive the plasma display panel. The plasma display device may display images by generating visible light by exciting the phosphor in the discharge cell with UV light generated during a gas discharge.

While the plasma display device is driven, a large amount of electromagnetic radiation may be generated. Therefore, a front filter including an electromagnetic wave shielding layer may be attached on a front surface of the plasma display panel. In addition, an external light shielding layer may be included in the front filter.

However, since the conventional electromagnetic wave shielding layer and external light shielding layer have different patterns, the conventional electromagnetic wave shielding layer and external light shielding layer may not coincide with each other, thereby lowering visible light transmission ratio in the plasma display panel. In addition, the conventional electromagnetic wave shielding layer and external light shielding layer may increase complexity and time length of the manufacturing process.

Further, the conventional external light shielding layer may include a black barrier with a predetermined height to absorb external light or to absorb visible light emitted from the plasma display panel in addition to absorbing external light. Accordingly, a transmission ratio of visible light emitted to the outside from the inside of the plasma display panel may be reduced, thereby decreasing a total brightness of the plasma display device.

SUMMARY

Embodiments are therefore directed to a display filter, a display device including the same, and a method of manufacturing the same, which substantially overcome one or more of the problems due to the limitations and disadvantages of the related art.

It is therefore a feature of an embodiment to provide a display filter having an external light shielding layer and an electromagnetic wave shielding layer with a substantially same pattern.

It is therefore another feature of an embodiment to provide a display filter having the external light shielding layer and electromagnetic wave shielding layer in a substantially same region of a structure projected from a base layer structure, thereby improving brightness and bright room contrast ratio of a display device.

It is yet another feature of an embodiment to provide a display device including a display filter having one or more of the above features.

It is still another feature of an embodiment to provide a method of manufacturing a display filter having one or more of the above features.

Additional advantages and features of embodiments will be set forth in part in the description which follows and in part will become apparent to those having ordinary skill in the art upon examination of the following or may be learned from practice of the embodiments.

At least one of the above and other features and advantages may be realized by providing a display filter, including a base layer having a plurality of structures that are projected from one surface thereof; an external light shielding layer formed on an upper surface and one side surface of the structure; and an electromagnetic wave shielding layer that is formed on an upper surface of the external light shielding layer formed on the upper surface of the structure and is formed on the other surface of the structure.

The external light shielding layer and the electromagnetic wave shielding layer may directly contact each other only on the upper surface of the structures, the upper surface of the structures facing away from the base layer. The external light shielding layer and the electromagnetic wave shielding layer may overlap a substantially same region of the base layer. One of the electromagnetic wave shielding layer and external light shielding layer may have a cross section of the Greek character "Γ," and a cross-section of the other of the electromagnetic wave shielding layer and external light shielding layer may be a mirror image of "Γ."

The plurality of structures may be formed in a stripe pattern.

The plurality of structures may be formed in a mesh pattern.

A vertical section of the structure may be rectangular.

The structure may be formed integrally with the base layer.

The base layer may be a tempered glass.

The base layer may be an optical film formed of at least one selected from polyethylene terephthalate, polycarbonate and polymethyl methacrylate.

A thickness of the external light shielding layer may be 10 nm to 5 μm.

A thickness of the electromagnetic wave shielding layer may be 10 nm to 5 μm.

The display filter may further include a hard coating layer formed on the other surface of the base layer.

The display filter may further include a reflection preventing layer formed on the other surface of the base layer.

At least one of the above and other features and advantages may also be realized by providing a plasma display device, including a plasma display panel including front and rear panels facing each other, a chassis base on the rear panel of the plasma display panel, and a display filter on the front panel of the plasma display panel, the display filter including a base layer having a plurality of structures, the plurality of structures being projected from a first surface of the base layer, an external light shielding layer on the plurality of structures, the external layer being on an upper surface and on a first side surface of the structures, and an electromagnetic wave shielding layer on the plurality of structures, the electromagnetic wave shielding layer being on the upper surface and on a second side surface of the structures, the first and second side surfaces of the structures being opposite each other, and a portion of the external light shielding layer being between the structures and a portion of the electromagnetic wave shielding layer.

A portion of the electromagnetic wave shielding layer on the upper surface of the structures may contact the front panel of the plasma display panel to define an air layer between the first surface of the base layer and the front panel of the plasma display panel. The electromagnetic wave shielding layer may be electrically coupled to the chassis base to ground electromagnetic wave.

At least one of the above and other features and advantages may also be realized by providing a method of manufacturing a display filter, including a base layer preparing step of preparing a base layer provided with a plurality of structures on one surface thereof, a first coating step of forming an external light shielding layer by coating black material on upper and one side surfaces of the structure, and a second coating step of forming an electromagnetic wave shielding layer by coating conductive material on an upper surface of the external light shielding layer formed on the upper surface of the structure and on the other side surface of the structure.

In the first coating step, the black material may be coated on the upper and one side surfaces of a first structure in a direction parallel to a first virtual line that is drawn from a corner between the upper and other side surfaces of a second structure to a corner between one side surface of the first structure and one surface of the base layer, where adjacent structures include the first structure, second and third structures arranged at both sides of the first structure, and the one side surface of the first structure faces the other side surface of the second structure.

In the second coating step, the conductive material may be coated on an upper surface of the external light shielding layer formed on the upper surface of the first structure and the other side surface of the first structure in a direction parallel to a second virtual line that is drawn from a corner between the upper and outer surfaces of the external light shielding layer formed on upper and one side surfaces of the third structure to a corner between the other side surface of the first structure and one surface of the base layer, where the other side surface of the first structure faces the outer surface of the external light shielding layer formed on one side surface of the third structure.

In addition, in the first coating step, the black material may be coated on the upper and one side surfaces of the first structure in a direction in which first and second angles coincide with each other, where the first angle is an angle between a direction of the external light propagating between the first and second structures and the other side surface of the second structure, and the second angle is an angle between a direction of coating the black material and the other side surface of the second structure.

In addition, in the second coating step, the conductive material may be coated on the upper surface of the external light shielding layer formed on the upper surface of the first structure and may be coated on the other side surface of the first structure, where the second angle coincides with a third angle that is formed between a direction of coating the conductive material between the first and third structures and the outer surface of the external light shielding layer formed on one side surface of the third structure.

The display filter may be provided in the plasma display device, where one surface of the base layer provided with the structure faces the front surface of the plasma display device and the external light shielding layer formed on one side surface of the structure faces an upper part of the front panel of the plasma display device.

BRIEF DESCRIPTION OF THE DRAWINGS

The above and other features and advantages will become more apparent to those of ordinary skill in the art by describing in detail exemplary embodiments with reference to the attached drawings, in which:

FIG. 7 illustrates a table comparing results of transmission ratio and bright room contrast ratio in a display filter according to an embodiment and a conventional filter;

FIG. 8 illustrates a flow chart of a method of manufacturing a display filter according to an embodiment;

FIG. 9 illustrates a cross-sectional view of a process for preparing a base layer of FIG. 8;

DETAILED DESCRIPTION

Figure 1:
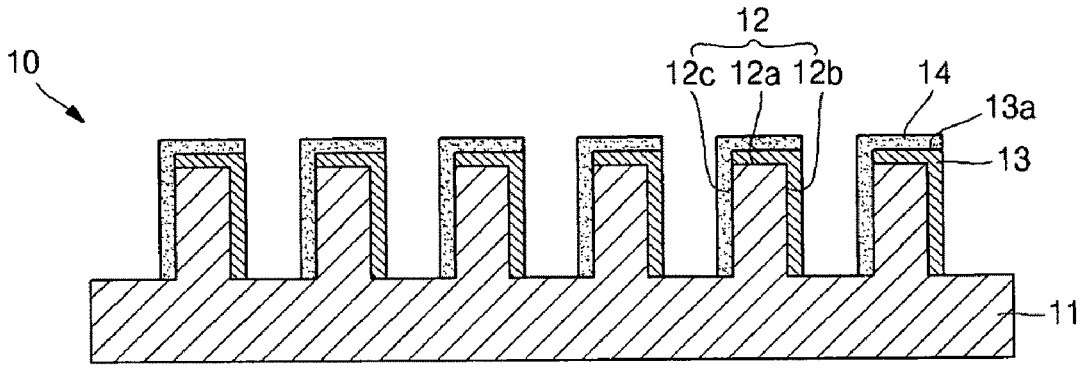
FIG. 1 illustrates a cross-sectional view of a display filter according to an embodiment of the present invention.

Korean Patent Application No. 10-2008-0124436 filed on Dec. 9, 2008, in the Korean Intellectual Property Office, and entitled: "Display Filter and Method of Manufacturing the Same", is incorporated by reference herein in its entirety.

Hereinafter, example embodiments will be described in detail with reference to the accompanying drawings. The aspects and features of the example embodiments, as well as methods for achieving the aspects and features, will be apparent by referring to the embodiments to be described in detail with reference to the accompanying drawings. However, the example embodiments may be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
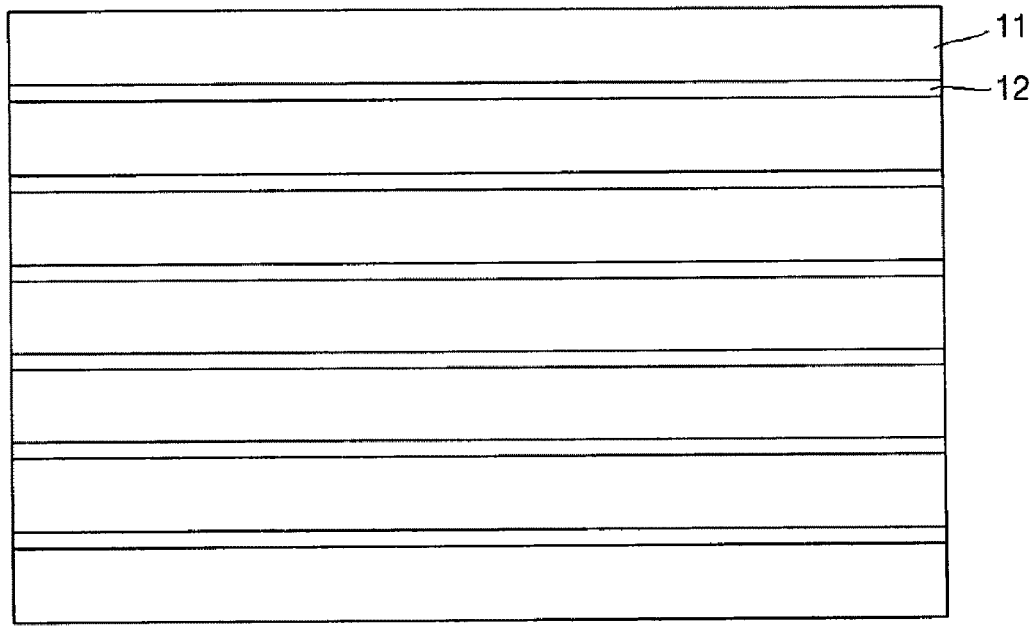
FIG. 2 illustrates a plan view of a pattern of a structure shown in FIG. 1.

FIG. 1 illustrates a cross-sectional view of a display filter according to one embodiment of the present invention, and FIG. 2 illustrates a plan view of a pattern of a structure shown in FIG. 1.

Referring to FIGS. 1 and 2, a display filter 10 may include a base layer 11, an external light shielding layer 13, and an electromagnetic wave shielding layer 14.

The base layer 11 may be a base of the display filter 10, and may be formed in a size, e.g., roughly, corresponding to a panel of a display device, e.g., a liquid crystal display (LCD), a plasma display panel (PDP), and so forth. The display filter 10 may be provided on the panel of the display device, e.g., the base layer 11 of the display filter 10 may be attached to the panel of the display device.

The base layer 11 may include a substantially flat film defined by first and second surfaces opposite each other. A plurality of structures 12 may be projected from the first surface of the base layer 11. The plurality of structures 12 may extend upward in a vertical direction, and may be spaced apart from each other by a predetermined gap along a first horizontal direction. The plurality of structures 12 may be formed so both the external light shielding layer 13 and electromagnetic wave shielding layer 14 may be formed thereon. Accordingly, the external light shielding function and electromagnetic wave shielding function may be simultaneously provided to the plurality of structures 12.

As illustrated in FIG. 2, the plurality of structures 12 may be formed in a horizontal stripe pattern. For example, each structure 12 may extend along a second horizontal direction, and may be spaced apart from an adjacent structure 12 along the first horizontal direction. It is noted that the vertical direction may be substantially normal to a plane defined by the first and second horizontal direction, e.g., the first and second horizontal directions may be substantially perpendicular to each other. The horizontal stripe pattern may facilitate provision of the external light shielding function and electromagnetic wave shielding function in the display device.

The plurality of structures 12 may be formed integrally on the first surface of the base layer 11 in order to simplify the manufacturing process. A cross-section of the structure 12 may be formed in any suitable shape, e.g., rectangular, hexagonal, octagonal, and so forth, in order to improve the electromagnetic wave shielding function by securing a line width of the electromagnetic wave shielding layer 14. For example, lengths of the base layer 11 and the structures 12 along the second horizontal direction may be substantially equal, as illustrated in FIG. 2.

The base layer 11 with the plurality of structures 12 may be formed, e.g., of transparent tempered glass, to transmit visible light emitted to the outside from the inside of the display device and to maintain strength when the display filter 10 is installed in the display device. In another example, the base layer 11 may be formed of an optical film made of a material having a high light transmission ratio, e.g., at least one of polyethylene terephthalate, polycarbonate, and polymethyl methacrylate.

As described previously, gaps may be defined on the base layer 11 between adjacent structures 12. The gaps between adjacent structures 12 may expose portions of the first surface of the base layer 11, so visible light may be emitted from the display device through an increased area in the base layer 11. In other words, interference of emission of visible light out of the display device may be removed due to the gaps. Thus, a transmission ratio of visible light from the display device may be improved.

The external light shielding layer 13 may be formed in a predetermined thickness on, e.g., directly on, an upper surface 12*a* and a first side surface 12*b* of the structure 12. It is noted that the upper surface 12*a* may face away from the base layer 11, and the first side surface 12*b* may be positioned between the upper surface 12*a* and the base layer 11, e.g., to connect therebetween. For example, the external light shielding layer 13 may overlap the entire upper surface 12*a* and first side surface 12*b* of the structure 12. The external light shielding layer 13 may absorb external light, i.e., light generated by a source external to the display device, in order to shield the display device from external light incident thereon. For that purpose, the external light shielding layer 13 may be formed of a light absorbing material, such as a black material, e.g., one or more of cobalt oxide, ruthenium oxide, and carbon black. Here, the external light shielding layer 13 may be formed to have a thickness of about 10 nm to about 5 μm. When the thickness of the external light shielding layer 13 is less than 10 nm, the thickness of the external light shielding layer 13 may be insufficient to absorb external light. When the thickness of the external light shielding layer 13 is more than 5 μm, a portion of the external light shielding layer 13 overlapping portions of the base layer 11 may be too thick, thereby minimizing a transmission area of visible light emitted from the display device, i.e., an increased thickness of the external light shielding layer 13 in a gap between adjacent structures 12 may reduce a width of the gap.

The electromagnetic wave shielding layer 14 may be formed in a predetermined thickness on the upper surface 12*a* of the structure 12 and on a second side surface 12*c* of the structure 12, i.e., a side surface opposite the first side surface 12*b*. In particular, the electromagnetic wave shielding layer 14 may be formed on, e.g., directly on, an upper surface 13*a* of the external light shielding layer 13, so a portion of the external light shielding layer 13 may be between the upper surface 12*a* of the structure 12 and the electromagnetic wave shielding layer 14. The electromagnetic wave shielding layer 14 may be, e.g., directly on the second side surface 12*c* of the structure 12. For example, the electromagnetic wave shielding layer 14 may overlap the entire upper surface 12*a* and second side surface 12*c* of the structure 12.

The electromagnetic wave shielding layer 14 may reflect visible light generated in the display device and may emit it to the outside, i.e., with respect to the display device. The electromagnetic wave shielding layer 14 may shield from electromagnetic radiation by grounding electromagnetic radiation generated in the display device to the grounding structure of the device. For that purpose, the electromagnetic wave shielding layer 14 may be formed of a material not absorbing light and having conductivity. For example, the electromagnetic wave shielding layer 14 may be formed of one or more of silver (Ag), copper (Cu), aluminum (Al), nickel (Ni), and gold (Au). Here, the electromagnetic wave shielding layer 14 may be formed to have a thickness of about 10 nm to about 5 μm. When the thickness of the electromagnetic wave shielding layer 14 is less than 10 nm, the electromagnetic wave shielding layer 14 may be too thin to ground electromagnetic waves. When the thickness of the electromagnetic wave shielding layer 14 is more than 5 μm, a portion of the electromagnetic wave shielding layer 14 overlapping portions of the base layer 11 may be too thick, thereby minimizing a transmission area of visible light emitted from the display device, i.e., a gap between adjacent structures 12 may be too narrow. For example, the electromagnetic wave shielding layer 14 and external light shielding layer 13 may have a substantially same thickness.

The electromagnetic wave shielding layer 14 and external light shielding layer 13 may have a substantially same structure, i.e., a structure overlapping upper and side surfaces of the structure 12, so the electromagnetic wave shielding layer 14 and external light shielding layer 13 may have similar cross-sections, i.e., mirror images of the Greek character capital gamma "Γ." For example, both the electromagnetic wave shielding layer 14 and external light shielding layer 13 may be formed to cover, e.g., only, surfaces of the structure 12, so the electromagnetic wave shielding layer 14 and external light shielding layer 13 may overlap a substantially same region of the base layer 11, i.e., the structure 12. As such, an exposed area of the base layer 11, i.e., an area overlapped by neither of the external light shielding layer 13 nor electromagnetic wave shielding layer 14, may be substantially increased.

As described above, the display filter 10 may provide both the external light shielding function and electromagnetic wave shielding function in one pattern by forming both the external light shielding layer 13 and electromagnetic wave shielding layer 14 on the stripe pattern of structure 12 projected from one surface of the base layer 11. Accordingly, the display filter 10 may eliminate or substantially minimize the problem of reduced transmission area of visible light due to pattern inconsistency. In other words, since the external light shielding layer 13 and electromagnetic wave shielding layer 14 have a substantially same structure in a substantially same portion of the base layer 11, an area of the base layer 11 not overlapping either of the external light shielding layer 13 or electromagnetic wave shielding layer 14 may be substantially increased. In contrast, when a conventional external light shielding layer of a stripe pattern and a conventional electromagnetic wave shielding layer of mesh pattern are respectively made and attached to a display device, the conventional external light shielding layer and electromagnetic wave shielding layer may overlap different portions of the display device, i.e., since they have different patterns, thereby minimizing an exposed area of the display device. Since an exposed area of the base layer 11 in the display filter 10 may be substantially increased as compared to a conventional filter, the display filter 10 according to example embodiments may provide improved brightness by increasing the transmission ratio of visible light emitted from the panel of the display device.

In addition, the external light shielding layer 13 and electromagnetic wave shielding layer 14 may be attached to the panel of the display device through a single process because both layers may be formed on the structure 12 of the stripe pattern. Accordingly, the display filter 10 may be manufactured by a simplified process, thereby having reduced manufacturing time and costs as compared to corresponding conventional layers formed separately as different patterns on different regions via two laminating processes.

Further, the display filter 10 may shield external light and minimize absorption of visible light emitted to the outside from the inside of the display panel by forming the external light shielding layer 13 substantially on the structure 12 of the stripe pattern. Accordingly, the display filter 10 may have improved brightness and bright room contrast ratio, as compared to a conventional filter having an external light shielding layer with a black barrier on a base material. Further, the display filter 10 may improve the transmission ratio of visible light emitted to the outside from the inside of the display panel through gaps formed between the plurality of structures.

Figure 3:
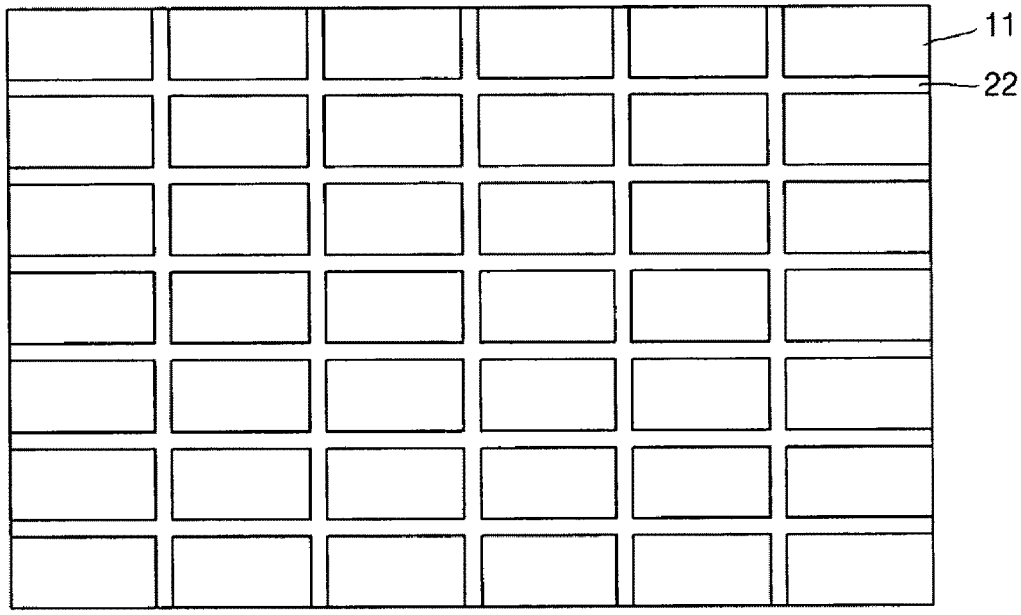
FIG. 3 illustrates a plan view of a pattern of a structure of a display filter according to another embodiment of the present invention.

A display filter according to another embodiment will be explained below with reference to FIG. 3. As illustrated in FIG. 3, the display filter may include the base layer 11 with structures 22.

The display filter in FIG. 3 may be substantially the same as the display filter 10 in FIGS. 1 and 2, with the exception of including the structures 22 instead of the structures 12. Accordingly, only the structure 22 will be described hereinafter.

FIG. 3 illustrates a plan view of the structures 22 on the base layer 11. The plurality of structures 22 may be projected vertically from the first surface of the base layer 11 as was described previously with reference to FIGS. 1 and 2.

The plurality of structures 22 may be formed in a mesh pattern including horizontal and vertical patterns. For example, the horizontal pattern, i.e., along the second horizontal direction, may be substantially the same as the structure 12 in FIGS. 1 and 2. The vertical pattern, i.e., along the first horizontal direction, may be used to shield electromagnetic wave in the display device. When the structure 22 is formed in the mesh pattern including the vertical pattern, the electromagnetic wave shielding function of the display filter may be improved further in the display device. In another example, both the vertical and horizontal patterns of the structures 22 may be substantially the same as the structures 12 in FIGS. 1 and 2.

The display filter in FIG. 3 may improve the electromagnetic wave shielding function and external light shielding function even further, as compared, e.g., to the display filter 10 in FIGS. 1 and 2 by including both of the external light shielding layer 13 and electromagnetic wave shielding layer 14 on the structure 22 of the mesh pattern.

Figure 4:
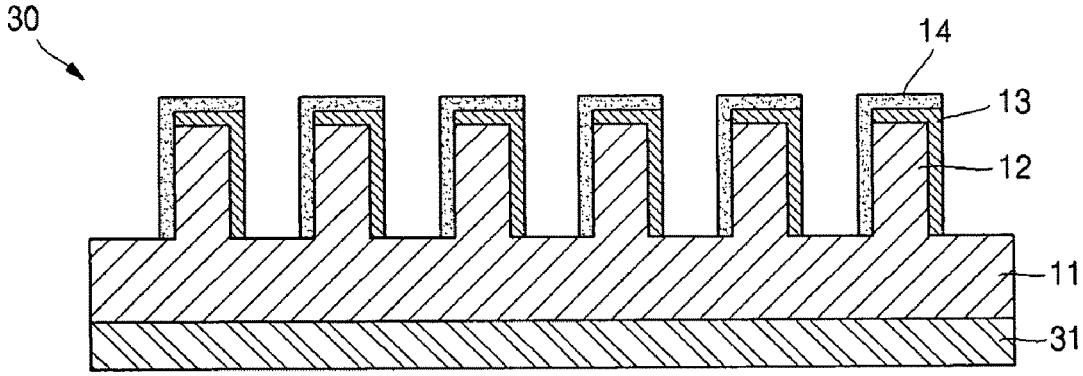
FIG. 4 illustrates a cross-sectional view of a display filter according to another embodiment of the present invention.

A display filter according to still another embodiment will be explained below with reference to FIG. 4. FIG. 4 illustrates a cross-sectional view of a display filter 30 according to another embodiment.

Referring to FIG. 4, a display filter 30 may be substantially the same as the display filter 10 described previously with reference to FIGS. 1 and 2, with the exception of further including a hard coating layer 31. Accordingly, explanation about the same elements will be omitted and the hard coating layer 31 different from the display filter 10 of FIG. 1 will be mainly explained.

Referring to FIG. 4, the display filter 30 may include the base layer 11, external light shielding layer 13, electromagnetic wave shielding layer 14, and hard coating layer 31.

The hard coating layer 31 may be formed on the second surface of the base layer 11, i.e., a surface facing away from the structures 12, in order to prevent damage, e.g., scratches, due to external force. For that purpose, the hard coating layer 31 may be formed, e.g., of one or more of an acrylic polymer, an epoxy polymer, and a siloxane group polymer. In another example, the hard coating layer 31 may be formed of UV hardening resin, e.g., an oligomer. The hard coating layer 31 may further include a silica group filler to improve hardness.

As described above, the display filter 30 may include the advantages of the display filter described previously. Further, the display filter 30 may exhibit improved hardness, thereby minimizing damages, e.g., scratches due to external force, thereto.

Figure 5:
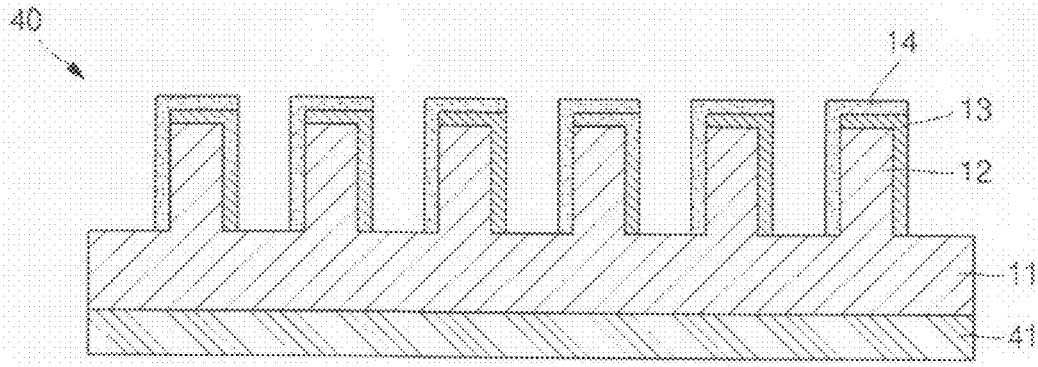
FIG. 5 illustrates a cross-sectional view of a display filter according to another embodiment of the present invention.

FIG. 5 illustrates a cross-sectional view of a display filter 40 according to still another embodiment. The display filter 40 may include the substantially same elements as the display filter 10 of FIG. 1, with the exception of further including a reflection preventing layer 41. Accordingly, explanation about the same elements will be omitted and the reflection preventing layer 41 different from the display filter 10 of FIG. 1 will be mainly explained.

Referring to FIG. 5, the display filter 40 may include the base layer 11, external light shielding layer 13, electromagnetic wave shielding layer 14, and reflection preventing layer 41.

The reflection preventing layer 41 may be formed on the second surface of the base layer 11, i.e., a surface facing away from the structures 12. The reflection preventing layer 41 may prevent reflection of external light and may reduce diffused reflection affecting a contrast ratio. For that purpose, the reflection preventing layer 41 may be formed, e.g., by stacking materials having different refractive indexes, e.g., one or more of $TiO_2$, $SiO_2$, $Y_2O_3$, $MgF_2$, and $Na_3AlF_6$, in a single layer or multi-layers.

As described above, the display filter 40 may include the advantages of the display filter 10 described previously with reference to FIGS. 1 and 2. Further, the display filter 40 may exhibit improved bright room contrast ratio due to the reflection preventing layer 41.

An example of a display device using a display filter according to example embodiments will be explained below with reference to FIG. 6. As an example, a plasma display device with the display filter 10 will be described with reference to FIG. 6. It is noted, however, that any of the display filters described above may be attached to any suitable display device.

Figure 6:
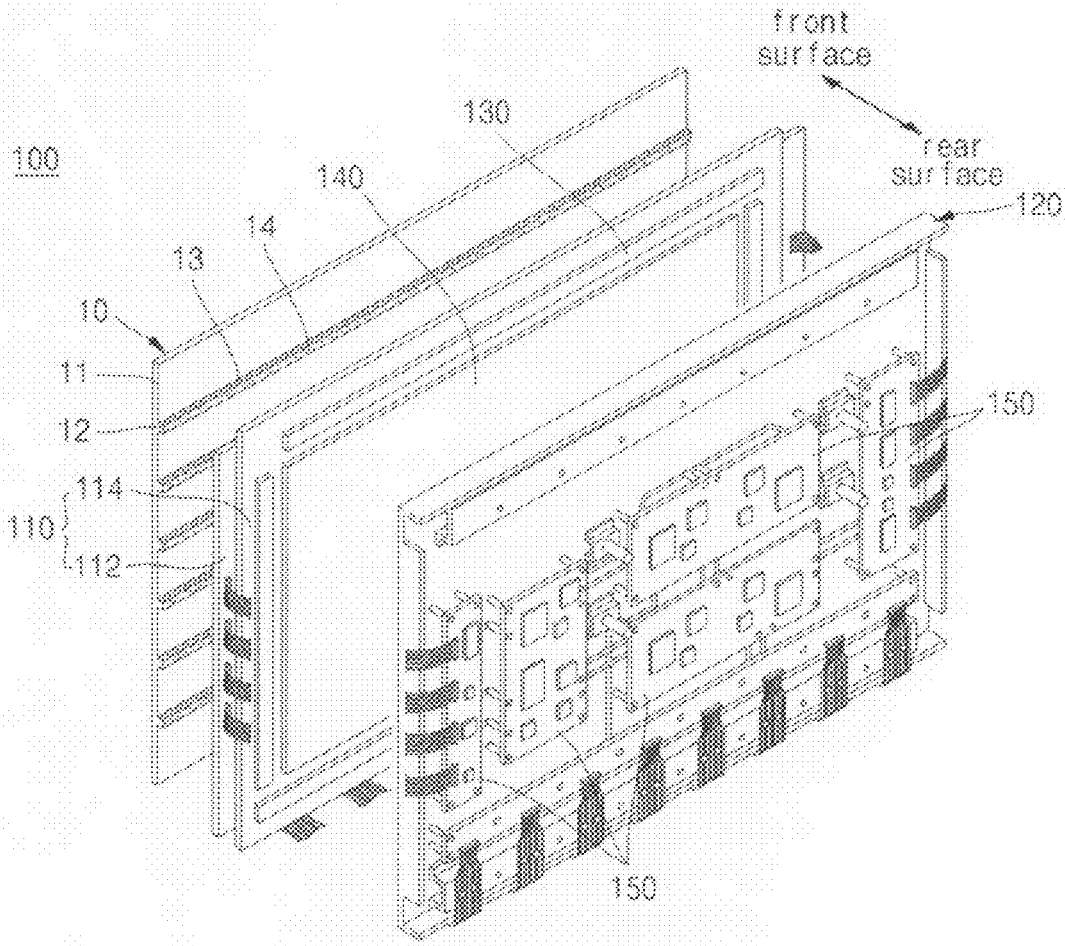
FIG. 6 illustrates an exploded perspective view of a plasma display device including a display filter according to an embodiment.

FIG. 6 illustrates an exploded perspective view of a plasma display device with the display filter 10.

Referring to FIG. 6, the display filter 10 may be provided on a front surface of a plasma display device 100. The display filter 10 was described previously and, therefore, its description will not be repeated.

The plasma display device 100 may include a plasma display device 110, a chassis base 120, and a driving circuit board 150.

The plasma display device 110 may be formed by bonding front and rear panels 112 and 114 to each other, and may display images.

The chassis base 120 may be attached to the rear panel 114 by an attaching member 130, so as to support the plasma display device 110. The chassis base 120 may be made of metal to function as a grounding unit. Accordingly, when the display filter 10 is installed in the plasma display device 100, the chassis base 120 may be electrically coupled to the electromagnetic wave shielding layer 14 of the display filter 10 so as to ground electromagnetic wave. Here, a heat radiation member 140 may be interposed between the chassis base 120 and rear panel 114. The heat radiation member 140 may release heat generated in the plasma display device 110 to the outside by transmitting the heat to the chassis base 120.

The driving circuit board 150 may be provided at the rear of the chassis base 120 and may drive the plasma display device 110. For that purpose, the driving circuit board 150 may include a circuit element to drive the plasma display device 110.

Figure 12:
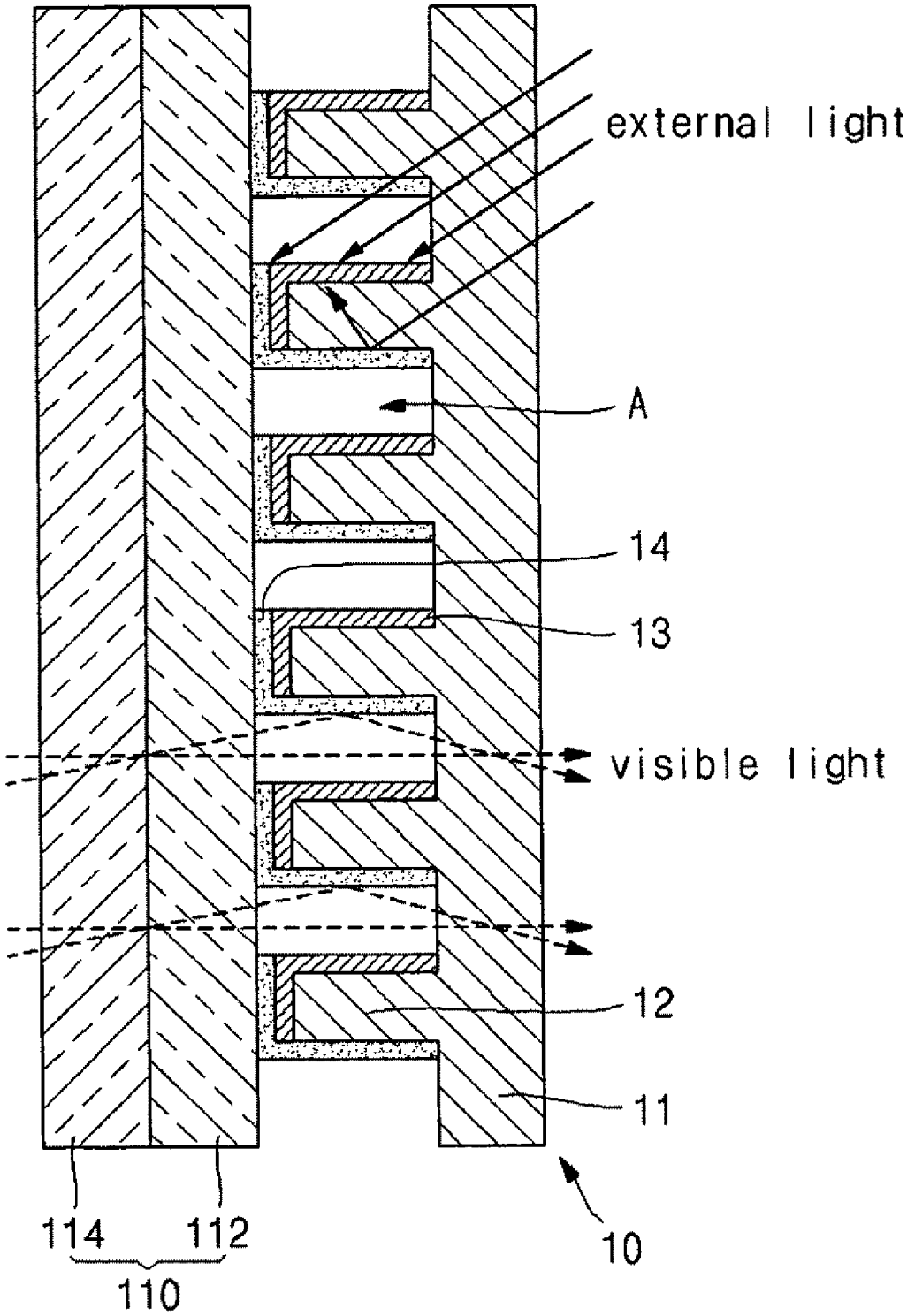
FIG. 12 illustrates a cross-sectional view of an attachment between a plasma display panel and a display filter according to an embodiment.

The display filter 10 and plasma display device 100 may be combined with each other by arranging the first surface of the base layer 11, i.e., the surface having the structures 12 thereon, to face the front panel 112 of the plasma display device 110. Accordingly, the structures 12 of the display filter 10 may be between the base layer 11 and the front panel 112. An edge of the plasma display device 100 may be fixed with an additional fixing member (not shown) to facilitate attachment of the display filter 10 to the plasma display device 100. When the display filter 10 and the plasma display device 100 are attached to each other, a portion of the electromagnetic wave shielding layer 14, i.e., a portion on the upper surface 12*a* of the structure 12, may be on, e.g., directly on, the front panel 112 of the plasma display device 110, so an air layer A may be formed between the base layer 11 of the display filter 10 and the plasma display device 100 (FIG. 12). The air layer A may improve the transmission ratio of visible light emitted to the outside from the inside of the plasma display device 100.

EXAMPLE

Display properties of the plasma display device 100 with the display filter 10 were compared to display properties of the plasma display device 100 with Comparative Filter 1 and Comparative Filter 2, i.e., usual filters 1 and 2 in FIG. 7. Comparative Filter 1 was a filter including an electromagnetic wave shielding layer and external light shielding layer formed separately and having different patterns. Comparative filter 2 was a filter including an electromagnetic wave shielding layer without an external light shielding layer. The tested display properties were visible light transmission ratio and bright room contrast ratio of the plasma display device 100. Comparison results are reported in a table in FIG. 7.

FIG. 7 illustrates a table of comparison results of the transmission ratio and bright room contrast ratio between the display filter 10 and Comparative filters 1 and 2.

Referring to FIG. 7, in the plasma display device 100 using the display filter 10 according to example embodiments, the visible light transmission ratio was 52% and the bright room contrast ratio was 900:1. In contrast, in the plasma display device 100 using the Comparative Filter 1, the visible light transmission ratio was 40% and the bright room contrast ratio was 850:1. In the plasma display device 100 using the Comparative Filter 2, the visible light transmission ratio was 56% and the bright room contrast ratio was 300:1.

The above results show that when the display filter 10 according to example embodiments was attached to the plasma display device 100, the plasma display device 100 exhibited improved visible light transmission ratio and bright room contrast ratio as compared to the plasma display device 100 with the Comparative Filter 1. In addition, the result shows that while the visible light transmission ratio of the display filter 10 was only a little lower than the visible light transmission ratio of the Comparative Filter 2, the bright room contrast ratio of the display filter 10 was substantially higher than the Comparative Filter 2. Accordingly, in consideration of both the visible light transmission ratio and bright room contrast ratio relevant to image quality of the plasma display device 100, the display filter 10 is most efficient to improve the image quality of the plasma display device 100.

A method of manufacturing a display filter according to example embodiments will be explained below. For convenience only, the method will be described with reference to the display filter 10 described previously.

FIG. 8 illustrates a flow chart of a method of manufacturing the display filter 10. FIG. 9 illustrates a cross-sectional view of a process for preparing the base layer 11, FIG. 10 illustrates a cross-sectional view of a first coating process for preparing the external light shielding layer 13, and FIG. 11 illustrates a cross-sectional view of a second coating process for preparing the electromagnetic wave shielding layer 14.

Referring to FIG. 8, the method of manufacturing the display filter 10 may include base layer preparing, i.e., operation (S1), a first coating step, i.e., operation (S2), and a second coating step, i.e., operation (S3).

Referring to FIG. 9, in operation 51, a plurality of structures 12 may be formed on the first surface of the base layer 11. The base layer 11 and structures 12 were explained previously with reference to FIGS. 1 and 2 and, therefore, explanation thereof will not be repeated.

Figure 10:
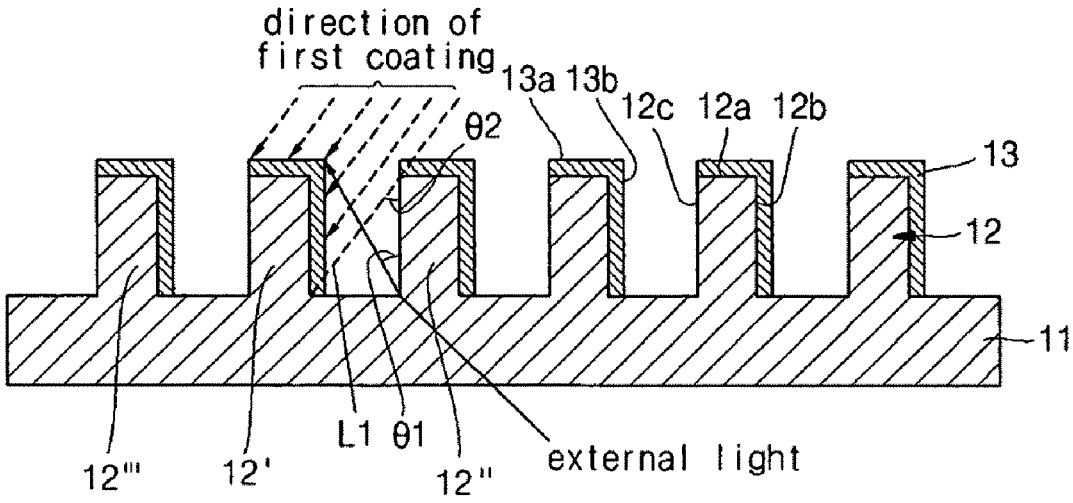
FIG. 10 illustrates a cross-sectional view of a first coating process of FIG. 8.
Figure 11:
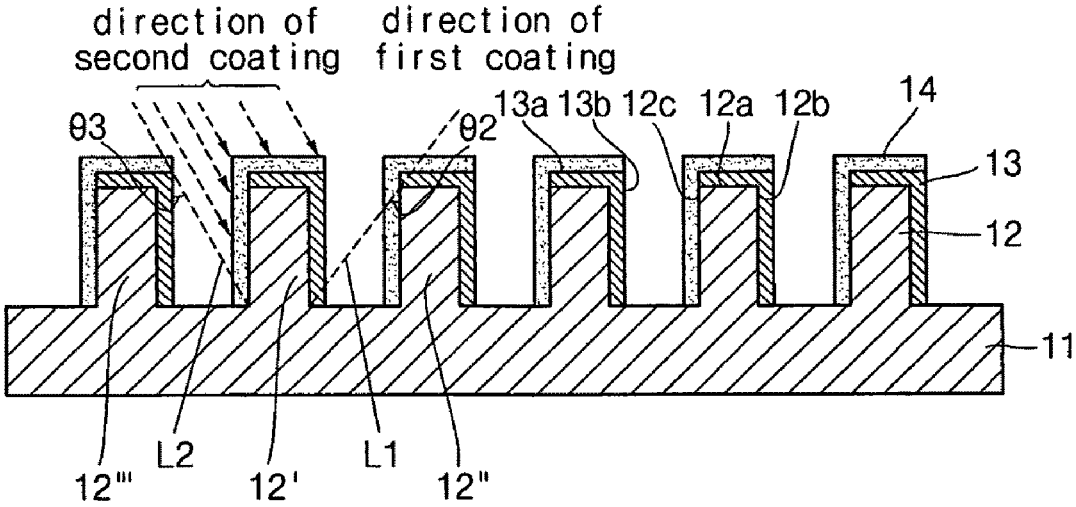
FIG. 11 illustrates a cross-sectional view of a second coating process of FIG. 8.

Referring to FIG. 10, in operation S2, an external light shielding layer 13 may be formed by coating, e.g., black material, on the upper surface 12*a* and first side surface 12*b* of the structure 12. For comprehension of operations S2 and S3, it is assumed that adjacent structures 12 include a first structure 12' between a second structure 12" and a third structure 12'", so the first side surface 12*b* of the first structure 12' may face the second surface 12*c* of the second structure 12".

In operation S2, the black material may be applied to the upper surface 12*a* and first side surface 12*b* of the structures 12 in a first direction parallel to a first virtual line L1. It is noted that the first virtual line L1 extends between a first point, i.e., a contact point between the second side surface 12*c* and upper surface 12*a* of the second structure 12", to a second point, i.e., a contact point between the first side surface 12*b* of the first structure 12' and the first surface of the base layer 11. Accordingly, in operation S2, the black material may be coated on the upper surface 12*a* and first side surface 12*b* of the structures 12 substantially without deviation.

In particular, the first direction for applying the black material may be adjusted with respect to a propagation direction of external light and the structures 12, e.g., height of the structures 12 and width of gaps therebetween. For example, the first direction may be adjusted to intersect a direction of the external light, so that first and second angles θ1 and θ2 may coincide with each other. In this respect it is noted that the first angle θ1 is an angle between the second surface 12*c* of the second structure 12" and a direction of the external light propagating between the first and second structures 12' and 12". The second angle θ2 is an angle between the first direction, i.e., direction of coating the black material, and the second surface 12*c* of the second structure 12". For example, the first direction may be adjusted to intersect a direction of the external light As described above and illustrated in FIG. 10, when external light is transmitted through the first surface of the base layer 11 toward the first side surface 12*b* of the structure 12, the external light shielding layer 13 formed on the upper surfaces 12*a* and first side surface 12*b* of the structure 12 may reduce the reflection brightness of the display device by absorbing external light incident on the second surface of the base layer 11 from the outside.

Referring to FIG. 11, in operation S3, the electromagnetic wave shielding layer 14 may be formed by coating a conductive material on both the upper surface 13*a* of the external light shielding layer 13 and the second side surface 12*c* of the structure 12.

In operation S3, the conductive material may be applied on the upper surface 13*a* of the external light shielding layer 13 formed on the upper surface 12*a* of the structure 12 and on second side surface 12*c* of the structures 12 along a second direction, i.e., a direction parallel to a second virtual line L2 illustrated in FIG. 11. The second virtual line L2 may connect a third point, i.e., a contact point between the upper surface 13*a* and outer side surface 13*b* of the external light shielding layer 13 formed on the third structure 12'", and a fourth point, i.e., a contact point between the second side surface 12*c* of the first structure 12' and the first surface of the base layer 11. The second side surface 12*c* of the first structure 12' may face the outer side surface 13*b* of the external light shielding layer 13 formed on the third structure 12'". Accordingly, in operation S3, the conductive material may be coated on the upper surface 13*a* of the external light shielding layer 13 and the second side surface 12*c* without substantial deviation.

In particular, the second direction for applying the conductive material may be adjusted with respect to the first direction of coating the black material and the structures 12, e.g., height of the structures 12 and width of gaps therebetween. For example, in operation S3, the second direction of coating the conductive material may be coated on the upper surface 13*a* of the external light shielding layer 13 formed on the upper surface 12*a* of the structure 12 and the second side surface 12*c* of the structure 12 may be adjusted to intersect the first direction, e.g., the second direction may be opposite the direction of external light, such that the second angle θ2 may coincide with a third angle θ3. It is noted that the third angle θ3 may be formed between the second direction and the outer side surface 13*b* of the external light shielding layer 13.

As described above, the electromagnetic wave shielding layer 14 formed on the upper surface 13*a* of the external light shielding layer 13 formed on the upper surface 12*a* of the structure 12 and on the second side surface 12*c* of the structure 12 may improve the brightness of the display device by reflecting visible light generated in the display device and emitted through the first surface of the base layer 11 to the outside.

For example, the display filter may be formed so that each of the first, second, and third angles θ1, θ2, and θ3 is within about 40° to about 50°, a coating thickness of the black material is about 1 μm to about 2 μm, and a coating thickness of the conductive material is about 1 μm to about 1.5 μm, so a sheet resistance of the display filter may be about 3.0 Ω/square or less. In other words, the sheet resistance of the display filter may be reduced when the display filter is made according to an example embodiment as described above.

An example of installing the display filter 10 made by the above method on the front of the plasma display device 100 will be described below.

FIG. 12 illustrates a cross-sectional view of the plasma display device 110 provided with the display filter 10 according to an embodiment.

Referring to FIG. 12, the display filter 10 may be installed on the front panel 112, so the first surface of the base layer 11, i.e., provided with the structure 12, may face the front panel 112 of the plasma display device 110 and the external light shielding layer 13 formed on the upper surface 12*a* of the structure 12 may face the front panel 112. The display filter 10 may contact the front panel 112, e.g., the external light shielding layer 13 may contact directly the front panel 112, so the air layer A may be formed between the display filter 10 and front panel 112. For example, the air layer A my correspond to a gap between adjacent structures 12, so each air layer A may be enclosed by an exposed first surface of the base layer 11, two adjacent structures 12, and the front panel 112. The air layer A may improve the transmission ratio of visible light emitted to the outside from the inside of the plasma display device 110.

As described above, the display filter 10 provided on the front panel 112 of the plasma display device 110 may absorb/shield external light incident on the upper part of the front panel 112 using the external light shielding layer 13 and may reflect visible light emitted from the front panel 112 using the electromagnetic wave shielding layer 14. In addition, the display filter 10 may reflect external light incident on the structure 12 using the electromagnetic wave shielding layer 14, so the light reflected from the electromagnetic wave shielding layer 14 may be absorbed into the external light shielding layer 13. Thus, the display filter 10 provided on the front panel 112 of the plasma display device 110 may improve the brightness and bright room contrast ratio of the plasma display device 100.

As described above, the display filter according to example embodiments may produce the following effects.

First, the display filter may provide both the external light shielding function and electromagnetic wave shielding function simultaneously by forming both the external light shielding layer and electromagnetic wave shielding layer with the same pattern, i.e., structure, on the structure projected from the base layer. Accordingly, the display filter may increase light transmission area in the display filter, i.e., may prevent or substantially minimize the problem that a transmission area of visible light is reduced when the two layers are respectively made to have different and inconsistent patterns, attached to the panel of the display device. Thus, the display filter may improve the brightness of the display device by increasing the transmission ratio of visible light emitted to the outside from the inside of the display panel.

Second, the external light shielding layer and electromagnetic wave shielding layer may be attached to the panel of the display device through a single process because the external light shielding layer and electromagnetic wave shielding layer are formed on the structure projected from the base layer, i.e., in a substantially same region of the display filter. Accordingly, the manufacturing process may be simplified and the manufacturing time may be reduced, as compared to a conventional filter having the electromagnetic wave shielding layer and external light shielding layer overlapping different regions of the filter and formed via two separate laminating processes.

Third, the display filter may shield external light and minimize absorption of visible light emitted to the outside from the inside of the display panel by forming the external light shielding layer on the portion of the structure. Accordingly, the display filter may improve the brightness and bright room contrast ratio compared to a conventional external light shielding layer including a black barrier, i.e., a black barrier absorbing both the external light and a large amount of visible light emitted to the outside from the inside of the display panel.

Fourth, the display filter may improve the transmission ratio of visible light emitted to the outside from the inside of the display panel through gaps formed between the plurality of structures.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A display filter, comprising:

a base layer having a plurality of structures, the plurality of structures being projected from a first surface of the base layer;

an external light shielding layer on the plurality of structures, the external layer being on an upper surface and on a first side surface of the structures; and an electromagnetic wave shielding layer on the plurality of structures, the electromagnetic wave shielding layer being on the upper surface and on a second side surface of the structures, the first and second side surfaces of the structures being opposite each other, and a portion of the external light shielding layer being between the structures and a portion of the electromagnetic wave shielding layer.

2. The display filter as claimed in claim 1, wherein the external light shielding layer and the electromagnetic wave shielding layer directly contact each other only on the upper surface of the structures, the upper surface of the structures facing away from the base layer.

3. The display filter as claimed in claim 1, wherein the external light shielding layer and the electromagnetic wave shielding layer overlap a substantially same region of the base layer.

4. The display filter as claimed in claim 1, wherein one of the electromagnetic wave shielding layer and external light shielding layer has a cross section of the Greek character "Γ," and a cross-section of the other of the electromagnetic wave shielding layer and external light shielding layer is a mirror image of "Γ."

5. The display filter as claimed in claim 1, wherein the plurality of structures are arranged in a stripe pattern.

6. The display filter as claimed in claim 1, wherein the plurality of structures are arranged in a mesh pattern.

7. The display filter as claimed in claim 1, wherein a cross-section of the structure is rectangular.

8. The display filter as claimed in claim 1, wherein the plurality of structures is integral with the base layer.

9. The display filter as claimed in claim 1, wherein the base layer includes a tempered glass or an optical film formed of one or more of polyethylene terephthalate, polycarbonate, and polymethyl methacrylate.

10. The display filter as claimed in claim 1, wherein a thickness of each of the external light shielding layer and the electromagnetic wave shielding layer is about 10 nm to about 5 μm.

11. The display filter as claimed in claim 1, further comprising a hard coating layer on a second surface of the base layer, the second surface of the base layer being opposite the first surface.

12. The display filter as claimed in claim 1, further comprising a reflection preventing layer on a second surface of the base layer, the second surface of the base layer being opposite the first surface.

13. A plasma display device, comprising:

a plasma display panel including front and rear panels facing each other;

a chassis base on the rear panel of the plasma display panel; and a display filter on the front panel of the plasma display panel, the display filter including:

a base layer having a plurality of structures, the plurality of structures being projected from a first surface of the base layer, an external light shielding layer on the plurality of structures, the external layer being on an upper surface and on a first side surface of the structures, and an electromagnetic wave shielding layer on the plurality of structures, the electromagnetic wave shielding layer being on the upper surface and on a second side surface of the structures, the first and second side surfaces of the structures being opposite each other, and a portion of the external light shielding layer being between the structures and a portion of the electromagnetic wave shielding layer.

14. The plasma display device as claimed in claim 13, wherein a portion of the electromagnetic wave shielding layer on the upper surface of the structures contacts the front panel of the plasma display panel to define an air layer between the first surface of the base layer and the front panel of the plasma display panel.

15. The plasma display device as claimed in claim 13, wherein the electromagnetic wave shielding layer is electrically coupled to the chassis base to ground electromagnetic wave.

16. A method of manufacturing a display filter, comprising:

forming a base layer having a plurality of structures, the plurality of structures being projected from a first surface of the base layer;

forming an external light shielding layer on the plurality of structures, the external layer being formed by coating black material on an upper surface and on a first side surface of the structures; and forming an electromagnetic wave shielding layer on the plurality of structures, the electromagnetic wave shielding layer being formed by coating a conductive material on the upper surface and on a second side surface of the structures, the first and second side surfaces of the structures being opposite each other, and a portion of the external light shielding layer being between the structures and a portion of the electromagnetic wave shielding layer.

17. The method as claimed in claim 16, wherein forming the external light shielding layer includes coating the black material in a first direction, the first direction being parallel to a first virtual line connecting first and second points, the first point being a contact point between the upper and second side surfaces of a first structure, the second point being a contact point between a first surface of the base layer and a first side surface of a second structure adjacent to the first structure, and the second side surface of the first structure facing the first side surface of the second surface.

18. The method as claimed in claim 17, wherein forming the electromagnetic wave shielding layer includes coating the conductive material in a second direction, the second direction being parallel to a second virtual line connecting third and fourth points, the third point being a contact point between upper and outer side surfaces of the external light shielding layer on the second structure, and the fourth point being a contact point between the first surface of the base layer and the second side surface of the first structure.

19. The method as claimed in claim 16, wherein forming the external light shielding layer includes coating the black material in a first direction, the first direction defining a first angle with the second side surface of a first structure and being adjusted so the first angle coincides with a second angle, the second angle being an angle between the second surface of the first structure and a direction of external light between the first structure and a second structure adjacent to the first structure.

20. The method as claimed in claim 19, wherein forming the electromagnetic wave shielding layer includes coating the conductive material in a second direction, the second direction being adjusted so the second angle and a third angle coincide, the third angle being an angle between the second direction and an outer side surface of the external light shielding layer of a third structure, the third angle being between a first side surface of the third structure and a second side surface of the first structure.

* * * * *